United States Patent [19]

Yaguchi

[11] Patent Number: 5,031,002

[45] Date of Patent: Jul. 9, 1991

[54] SUCTION-TYPE SHEET CARRYING MECHANISM APPLIED TO AN IMAGE FORMING APPARATUS

[75] Inventor: Masanori Yaguchi, Inagi, Japan

[73] Assignee: Fujitsu Limited, Kawasaki, Japan

[21] Appl. No.: 607,629

[22] Filed: Oct. 31, 1990

Related U.S. Application Data

[63] Continuation of Ser. No. 257,009, Oct. 13, 1988, abandoned.

[30] Foreign Application Priority Data

Oct. 23, 1987 [JP] Japan ..... 62-266234
May 7, 1988 [JP] Japan ..... 63-60484[U]

[51] Int. Cl.[5] ..... G03G 21/00

[52] U.S. Cl. ..... 355/312; 271/196; 271/307; 271/310; 271/900; 355/315

[58] Field of Search ..... 271/900, 307, 310, 197, 271/196; 355/312, 315

[56] References Cited

U.S. PATENT DOCUMENTS 3,545,746 6/1968 Ledger et al. ..... 271/196
3,826,568 7/1974 Hudson ..... 355/315
3,893,760 7/1975 Thettu ..... 355/315
3,895,793 7/1975 Bigenwald ..... 271/310
4,291,970 9/1981 Di Francesco ..... 355/312 X
4,411,420 10/1983 Louis et al. ..... 271/197 X

FOREIGN PATENT DOCUMENTS 58-55957 4/1983 Japan .

*Primary Examiner*—A. T. Grimley
*Assistant Examiner*—Thu Dang
*Attorney, Agent, or Firm*—Staas & Halsey

[57] ABSTRACT

A suction type sheet carrying mechanism for a high speed image forming apparatus, in which a sheet is separated from an electrophotosensitive drum by air suction performed by mechanically combining fixed air suction holes of a hollow shaft and rotated air suction holes of belt pulleys. The sheet is stuck onto rotating endless belts and carried along a curved route by air suction performed by combining moving air holes of moving endless belts. High speed air flows through ditches provided on a belt guide board placed under the endless belts. The sheet is carried through a fixing unit under high temperature circumstances by rotating air suction metal rollers arranged perpendicular to the direction in which the sheet is carried. Fixed air suction holes in a hollow shaft and rotating air suction holes at ring-shaped ridges of a cylinder rotated around the hollow shaft of each air suction metal roller combine to form suction to hold the sheet.

10 Claims, 9 Drawing Sheets

SUCTION-TYPE SHEET CARRYING MECHANISM APPLIED TO AN IMAGE FORMING APPARATUS

This is a continuation of co-pending application Ser. No. 07/257,009 filed on 10/13/88 now abandoned.

BACKGROUND OF THE INVENTION

The present invention relates to an image forming apparatus for transcribing an image onto a recording sheet by using toner. Particularly, the present invention is directed to a suction-type sheet carrying mechanism for a high speed image forming apparatus.

Recently, an image forming apparatus has been widely used for transcribing an image onto a recording sheet by using toner as seen in an electrophotographic duplicator. The image forming apparatus is separated into two types, a low speed type operating at a low transcribing speed such as 10 sheets per minute and a high speed type operating at a high transcribing speed such as 100 sheets per minute. The present invention relates to a high speed type image forming apparatus.

In the image forming apparatus, a train of electrical image signals to be transcribed is fed to the image forming apparatus, then a toner image is developed on a photosensitive surface of an image forming medium such as a rotated photosensitive drum or circulated belt, the toner image is transcribed onto a recording sheet at an image transcription unit, and then a toner image transcribed on the recording sheet is fixed at a fixing unit.

In the image transcription unit, the toner image on the image forming medium is transcribed onto the recording sheet by a charging action. However, the charge is discharged also in the image transcription unit after the image transcription on the recording sheet is over. Therefore, the charge still remains on the recording sheet, so that the recording sheet is hard to separate from the photosensitive surface.

The recording sheets fed to the image transcription unit are sent from a sheet cassette and those passed through the image transcription unit are sent to a sheet stacker through a fixing unit. Such a transfer of the recording sheet is performed by a sheet carrying mechanism. The sheet carrying mechanism is divided into two: a first sheet carrying mechanism for carrying the sheet from the sheet cassette to the image transcription unit and a second sheet carrying mechanism for carrying the sheet from the the image transcription unit to the sheet stacker. The present invention is directed to the second sheet carrying mechanism.

In the high speed image forming apparatus, a metal belt, forming a photosensitive layer thereon, has been used as the image forming medium. However, a photosensitive drum, which will be simply called a "drum" hereinafter, is better than the metal belt because the high speed image transcription can be performed more economically; is more stable, and has a longer life. However, a diameter of the drum cannot be made small because the units for toner image forming, developing and transcription are all required to be arranged close to the drum. Therefore, there is a problem in the second carrying mechanism that the recording sheet just passed through the image transcription unit tends to be stuck electrostatically to a cylindrical surface of the drum. In other words, the recording sheet just passed through the image transcription unit is difficult to separate from the cylindrical surface when the usual belts and rollers or pulleys are used in the second carrying mechanism. As long as the usual belts and rollers are used in the second carrying mechanism, the usual belt type image forming medium may be superior, compared with a drum type image forming medium because the belt type medium can be turned with a small radius, using a roller having a small radius, at an ejecting point of the recording sheet from the image transcription unit. This can provide a potential problem in the second sheet carrying mechanism.

In the second sheet carrying mechanism of the high speed image forming apparatus using the drum, there are still two other problems with respect to a very strong fixing flush light irradiated from the fixing unit. The very strong flush light is required to fix the toner image onto the recording sheet being carried at high speed.

One of two other problems is that a sheet carrying route between the image transcription unit and the fixing unit is required to be curved and run through a narrow portion for preventing the fixing flush light from leaking onto the cylindrical surface of the drum along the sheet carrying route. Therefore, the recording sheet cannot be reliably carried by the usual sheet carrying mechanism. Particularly, since a surface of the recording sheet on which the toner image is transcribed is very delicate before the toner image is fixed, the recording sheet must be tightly set on the sheet carrying mechanism and carefully carried. This is not easy at the high carrying speed of the recording sheet.

The other problem is that a nonmetallic belt cannot be used for carrying the recording sheet through a fixing path in the fixing unit because the nonmetallic belt is damaged by heat due to the flush light. However, a metallic belt is difficult to use for high speed revolution and has a short.

These problems can be solved by introducing a suction-type sheet carrying mechanism in the second sheet carrying mechanism. The suction-type sheet carrying mechanism is a mechanism by which the recording sheet is stuck to a carrying medium such as a belt by air suction.

The suction-type sheet carrying mechanism has been applied to the sheet carrying mechanism. The Japanese laid open patent application SHOH 58-55957 to J. SHINOZAKI on Apr. 2, 1983, is an example of a device for separating the recording sheet from drum surface. According to SHINOZAKI, the sheet is separated from the drum surface by a separation unit applying the air suction technique located at the sheet exit of the image transcription unit. The separation unit comprises an endless belt having a plurality of belt holes and an air suction mechanism associated with the belt holes. The air suction at the air suction mechanism is carried out, particularly by applying an air valve in an air exhausting route for increasing an instantaneous suction force of air. The feature of SHINOZAKI is to perform air suction using belt holes. Accordingly, this reference assumes there is a lot of air leakage at the connection between the belt holes and the air suction mechanism because the structure of the air suction mechanism is too complicated, which may be a reason of introducing the air valve in the air exhausting route.

SUMMARY OF THE INVENTION

An object of the present invention, therefore, is to improve the second sheet carrying mechanism in the high speed image forming apparatus so that the recording sheet can be parted from the rotating drum surface with a simple mechanism, high reliability and without wasting power.

Another object of the present invention is to improve the second sheet carrying mechanism in the high speed image forming apparatus so that the recording sheet can stably carried along the curved sheet carrying route with high reliability and preventing the flush light from directly irradiating the drum surface.

Still another object of the present invention is to improve the second sheet carrying mechanism in the high speed image forming apparatus so that the recording sheet can be carried through the fixing unit and is stably fixed with high reliability for a long time under a high temperature produced by the flush lamp of the fixing unit.

Another object of the present invention is to improve the second sheet carrying mechanism in the high speed image forming apparatus so that the recording sheet can be carried through the fixing unit and fixed economically without using extra parts, lowering the cost and lowering the power consumption.

The above objects of the present invention are achieved by applying a new suction-type sheet carrying mechanism to the second sheet carrying mechanism. The new suction-type sheet carrying mechanism comprises sheet suction pulley means for separating the recording sheet form the drum surface and is placed at the sheet exit of the image transcription unit, and sheet suction belt means for carrying the recording sheet along the curved route between an image transcription unit and the fixing unit. In addition, a sheet suction roller means is provided for carrying the recording sheet through the fixing unit and fixing the toner image on the recording sheet under a flush light.

The sheet suction pulley means comprises a metal cylinder connected with air suction means such as an air duct and an air exhausting blower and a plurality of metal pulleys rotating around the cylinder. The number of pulleys is the same as the number of endless belts running in parallel. Each pulley has a frame, a which no belt is loaded and stretched toward the next pulley, having approximately the same height as the pulley from an axis of the cylinder. The cylinder has air suction holes, directed toward the drum surface, equal to the number of pulleys, and the frame of the pulleys has a plurality of holes. Accordingly, every time one of the holes of the frame coincides with one of the air suction holes during the rotation of the pulleys by the belts, the recording sheet transferred on the belts is suctioned to the cylinder. Since the sheet suction is performed sequentially by respective pulleys, the recording sheet can be, tightly attached to the endless belts running in parallel. Since the cylinder and the frame of the pulleys are made of metal and the belts have holes therein, the air holes in the cylinder and the holes in the frame can be connected tightly without any air leakage. Therefore, a strong force for suctioning the recording sheet can be obtained without particularly increasing the air suction force from the air suction means. As a result, the recording sheet just passed through the image transcription unit can be separated from the drum surface even though the carrying speed of the recording sheet is high and the radius of the drum is large.

The sheet suction belt means comprises conventional belts made of dipped fluororubber, running in parallel, each having a plurality of holes, and a hollow base on which the belts are moved by sliding on the outer surface of the hollow base. The hollow base has a hollow chamber connected to air suction means such as an air duct and an air exhausting blower. The outer surface of the hollow base has a plurality of air suction holes connected to the hollow chamber for sucking air therethrough. Therefore, when the recording sheet is transferred to the outer surface of the hollow base, the recording sheet is suctioned against the hollow base every time one of the holes of the belts and one of the air holes of the hollow base coincide. In the present invention however, an additional narrow air-flow path connected to the air suction holes is provided in the hollow chamber along each belt. This air-flow path is for increasing the suction force to the recording sheet in accordance with Bernoulli's theorem without increasing the air exhausting rate of the air suction means.

The sheet suction roller means comprises a sheet guide board and a plurality of sheet suction rollers arranged perpendicular to the carrying direction of the recording sheet. A space is left between the sheet guide board and the sheet suction rollers. Each sheet suction roller comprises two metal cylinders, an inner cylinder and an outer cylinder. The inner cylinder is fixed to the image forming apparatus and has a hollow chamber connected to the air suction means such as an air exhausting duct and an air exhausting blower. The inner cylinder has a plurality of air suction holes directed toward the recording sheet on the sheet suction rollers. The outer cylinder has a plurality of ring shaped ridges extending outward so that an edge of each ridge appears from the metal sheet guide board through a hole provided in the guide board, and a plurality of holes are provided in each ridge. The outer cylinder is rotated around the inner cylinder by driving means so that every time the hole of the ridge coincides with the air suction hole of the inner cylinder, the recording sheet is suctioned to the cylinder and sent toward the next ridge of the next sheet suction roller as the outer cylinder rotates. Such sheet suction-and-carry action is performed by the ridges of the succeeding sheet suction rollers, so that the recording sheet can be carried, receiving the flush light in the fixing unit. Applying the sheet suction roller means to the fixing path, the second sheet carrying mechanism in the fixing path stably carries the recording sheet and has a long life.

BRIEF DESCRIPTION OF THE DRAWINGS

FIG. 1(*b*) is a plan view of a prior art suction-type sheet carrying mechanism;

FIG. 2(*b*) is a plan view of a curved suction-type sheet carrying mechanism;

FIG. 5(*b*) is a cross-sectional view of the sheet suction pulley mechanism at a line c—c' in FIG. 5(*a*);

DESCRIPTION OF THE PREFERRED EMBODIMENTS

Before describing a suction-type sheet carrying mechanism of the present invention, prior art suction-type sheet carrying mechanisms will be explained with reference to FIGS. 1(*a*) and 1(*b*). The sheet suction belt means is the most popular example of the prior art suction-type sheet carrying mechanism.

Figure 1:
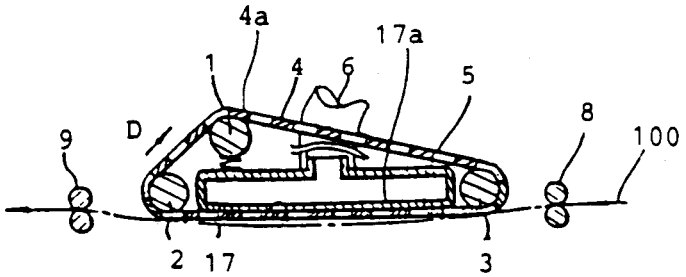
FIG. 1 (a) PRIOR ART
FIG. 1(*a*) is a cross-sectional side view of a prior art suction-type sheet carrying mechanism taken along the line A—A' in FIG. 1(*b*)
Figure 1:
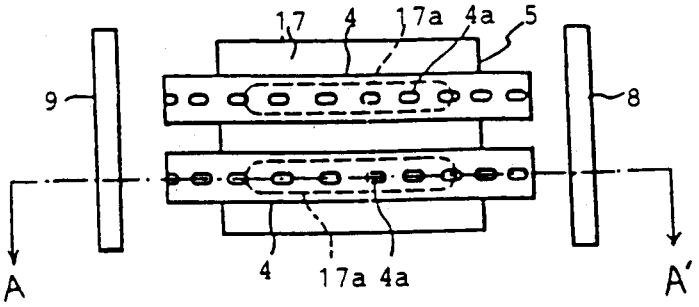
FIG. 1 (b) PRIOR ART

FIG. 1(*a*) is cross-sectional view of a prior art sheet suction belt means taken at a line A—A' in FIG. 1(*b*). FIG. 1(*b*) is a bottom view of the prior art sheet suction belt means. A sheet 100 is carried under a plurality of endless belts 4, two belts 4 in this example, beneath a flat board 17 by a roller 8 and suctioned to the belts 4 by a suction force produced by the air sucked through a plurality of holes 4*a* provided in the belts 4 and a long hole 17*a* provided in the flat board 17 corresponding to each belt 4 so that the width of each long hole 17*a* is narrower than the width of the belt 4. The belts 4 are driven in a direction D by a driving roller 2, associated with a tension pulley 1 and a regular pulley 3. The lower flat board 17 is equal to a bottom flat wall of an air suction chamber 5 connected to an air exhausting blower not depicted in FIG. 1(*a*), through an air duct 6. The sheet 100 is carried on the belts 4 and ejected by a roller 9.

Figure 2:
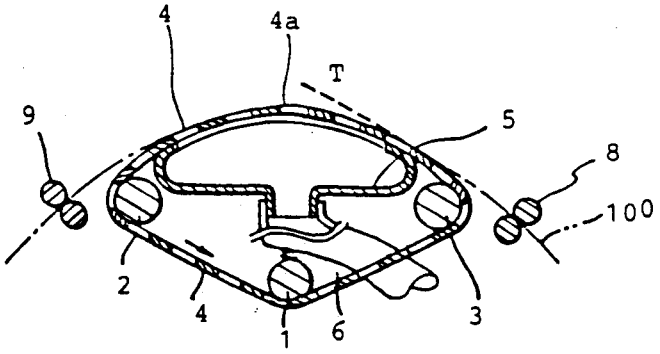
FIG. 2 (a) PRIOR ART
FIG. 2(*a*) is a cross-sectional side view of a curved suction-type sheet carrying mechanism taken along line B—B' in FIG. 2(*b*)
Figure 2:
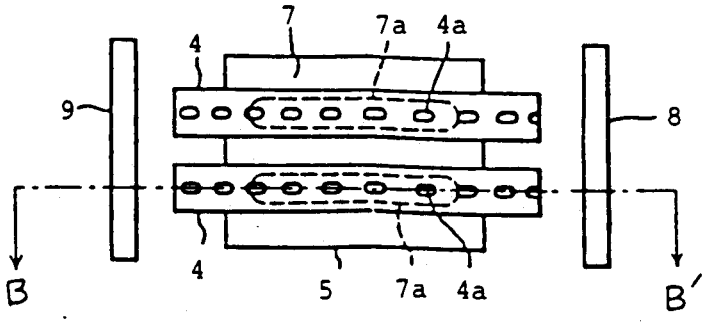
FIG. 2 (b) PRIOR ART

A curved suction-type sheet carrying mechanism has been derived as shown in FIGS. 2(*a*) and 2(*b*). FIG. 2(*a*) is a cross-sectional view of a curved suction-type sheet carrying mechanism taken at a line B—B' in FIG. 2(*b*). FIG. 2(*b*) is a bottom view of the curved suction-type sheet carrying mechanism. In FIGS. 2(*a*) and 2(*b*), the same reference numeral as in FIGS. 1(*a*) and 1(*b*) designate the same unit or part as in FIGS. 1(*a*) and 1(*b*). The curved suction-type sheet carrying mechanism has a problem that the sheet 100 cannot be stably carried when the sheet carrying speed increases because the sheet tends to go off in a tangential direction T to the curve, although this phenomenon depends on the rigidity of the sheet 100. This problem is solved by the present invention which will be disclosed later.

Figure 3:
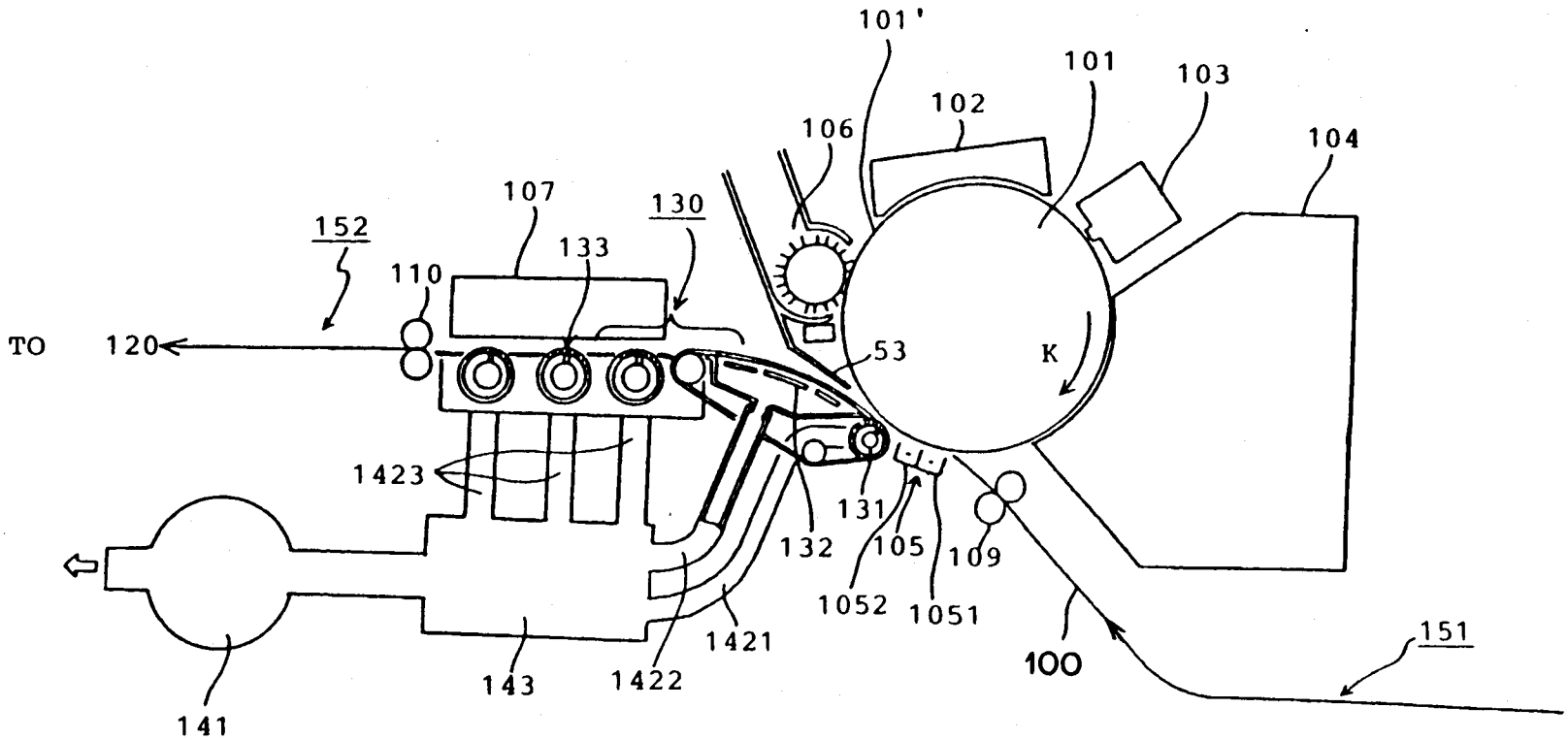
FIG. 3 is a diagram of a suction-type sheet carrying mechanism embodying the present invention applied to an image forming apparatus.

FIG. 3 is a block diagram of a suction-type sheet carrying mechanism embodying the present invention applied to an image forming apparatus. In FIG. 3, a photosensitive drum 101, rotated clockwise as indicated by an arrow K, is charged uniformly by a pre-charger 102. A latent image, corresponding to an image signal fed to the image forming apparatus to be recorded is formed on a cylindrical drum surface 101' of the drum 101 by a light irradiating unit 103. The latent image is developed by a developing unit 104, forming a toner image on the drum surface 101'. A recording sheet 100 is sent to an image transcription unit 105 from a sheet cassette 108, which is not depicted in FIG. 3, by a first sheet carrying mechanism 151. A carrying roller 110 in FIG. 3 is an element of the first sheet carrying mechanism 151. The toner image on the drum surface 101' is transcribed onto the sheet 100 by the image transcription unit 105. A cleaning unit 106 is for cleaning the toner left on the drum surface 101' after the image transcription. The image transcription unit 105 includes an image transcribing charger 1051 for transcribing the toner image on the drum surface 101' onto the sheet 101 by electrostatic charge and an AC corona discharger 1052 for removing the electrostatic charge on the sheet 101 after the image transcription. After the image transcription, the sheet 100 is transferred to a sheet stacker 120, which is not depicted in FIG. 3, through a fixing unit 107, by a second sheet carrying mechanism 152 comprising a suction-type sheet carrying mechanism 130 and carrying rollers one of which is a carrying roller 109 shown in FIG. 3.

Figure 4:
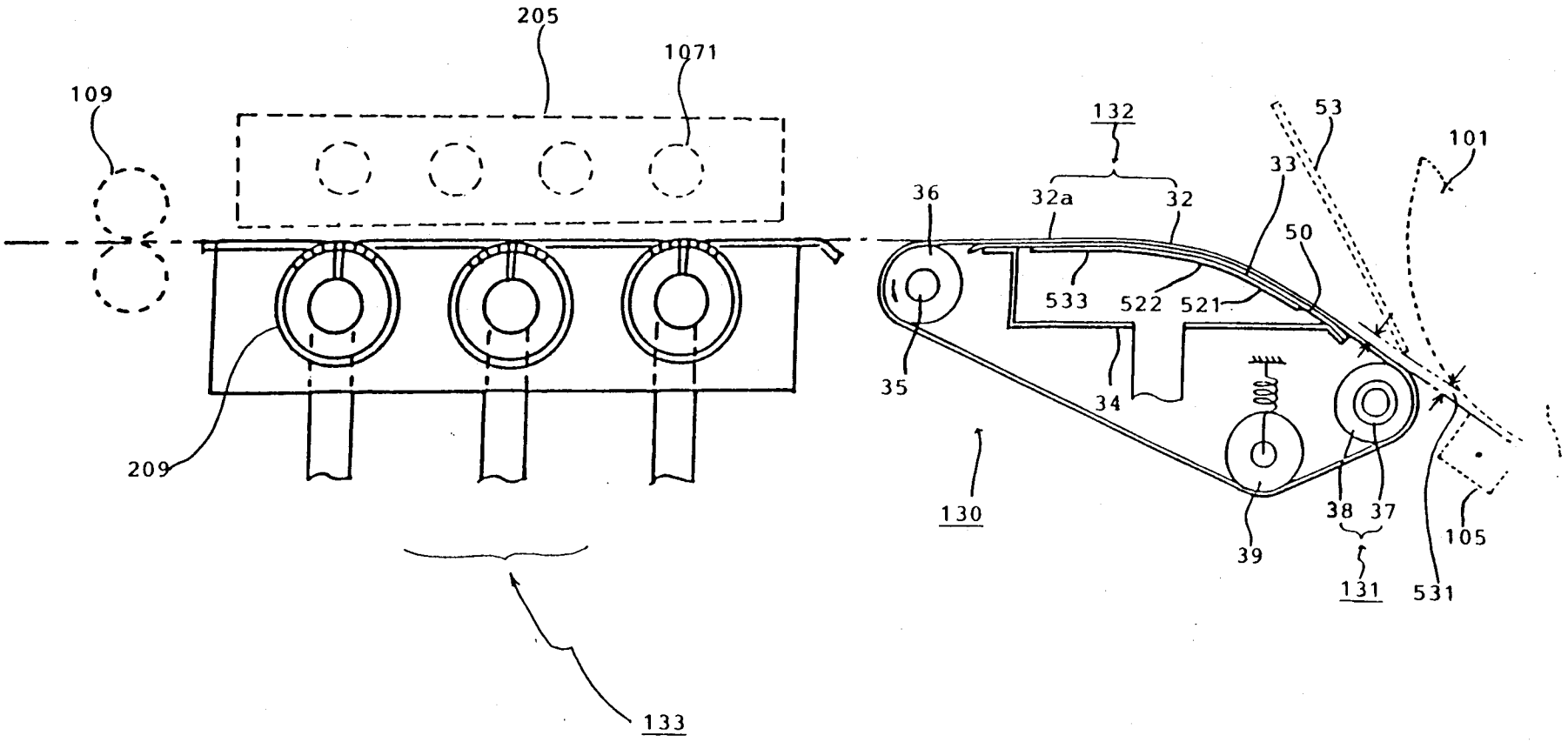
FIG. 4 is a diagram showing three suction-type sheet carrying mechanisms of the present invention.

The present invention relates to the suction-type sheet carrying mechanism 130 in FIG. 3, and the details of the suction-type sheet carrying mechanism 130 are shown in FIG. 4. As shown in FIG. 4, the suction-type sheet carrying mechanism 130 includes a sheet suction pulley mechanism 131 for separating the sheet 100 from the drum surface 101' after discharging by the AC discharger 1052 of the image transcription unit 105, a sheet suction belt mechanism 132 for carrying the sheet 100 from the sheet suction mechanism 131 to the fixing unit 107 by endless belts 32 along a curved route 33 for preventing the flush light of the fixing unit 107 from irradiating the drum surface 101' through a gap 531 between an optically shielding board 53 and the belts 32, and a sheet suction roller mechanism 133 for making the toner image stably fix to the sheet 100 during the time the sheet 100 is carried through the fixing unit 107, using the flush light irradiated from xenon lamps 1071 in the fixing unit 107.

As shown in FIG. 3, the air suction at the sheet suction pulley mechanism 131, the sheet suction belt mechanism 132 and the sheet suction roller mechanism 133, is carried out by an air exhausting blower 141 whose air capacity can be changed from 2.1 $mm^3$/min to 3.0 $mm^3$/min, using air ducts 1421, 1422 and 1423, respectively, and an air exhausting room 143. As shown in FIG. 4, the belts 32 are driven by a driving pulley 36 connected to a driving motor (not depicted in FIG. 4) and circulated by passing through tension pulleys 39 and regular pulleys 38. However, as will be explained below, a frame used for air suction is added to each pulley 38.

Figure 5:
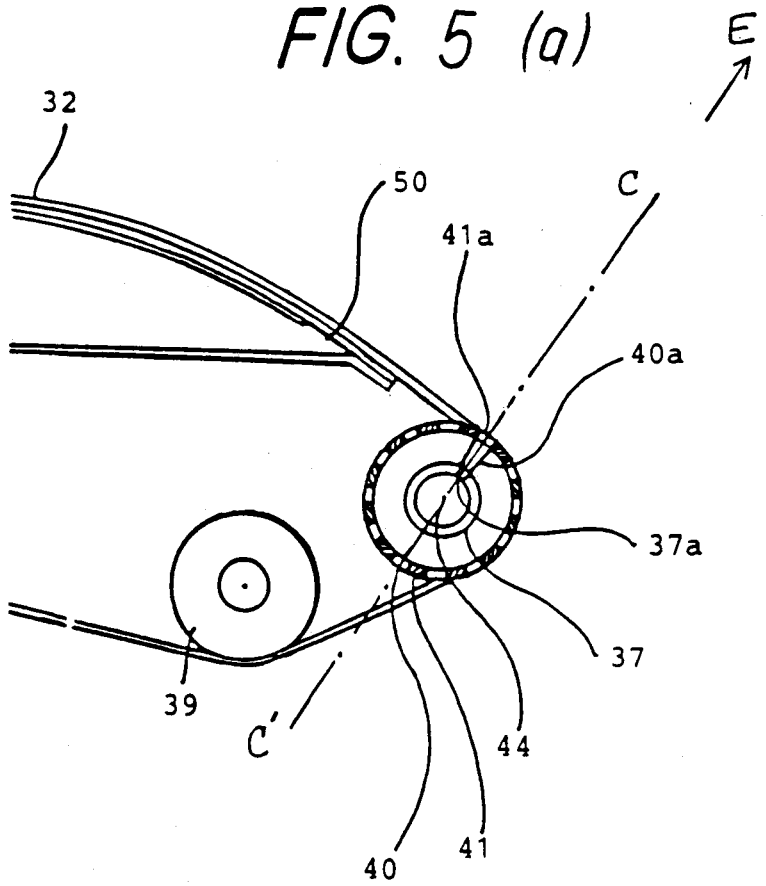
FIG. 5(*a*) is a partial cross-sectional side view of a sheet suction pulley mechanism shown in FIG. 4.
Figure 5:
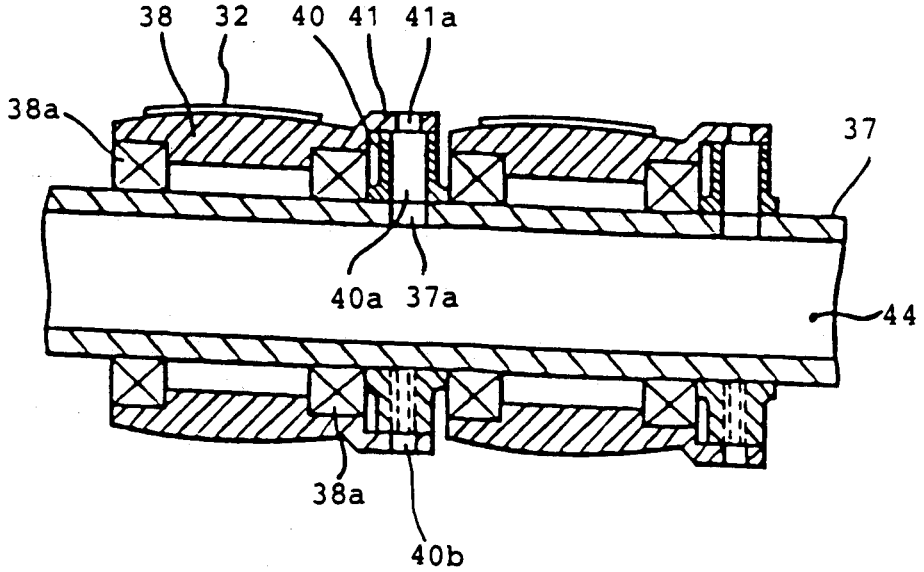

FIGS. 5(*a*) is a partial view of the sheet suction pulley mechanism 131 in FIG. 4, and FIG. 5(*b*) is a cross-sectional view at line c—c' in FIG. 5(*a*). The sheet suction pulley mechanism 131 includes a metal hollow cylinder shaft 37 having a hollow 44 connected to the air exhausting blower 141 through the air duct 1421 and metal pulleys 38 (FIG. 5(*b*)). The number of metal pulleys 38 equals the number of belts 4, and are rotated around the hollow cylinder 44 through bearings 38*a*. To the metal hollow shaft 37 having an outside diameter of approximately 20 mm and an inner diameter of approximately 14 mm, metal rings 40 being the same in number to the number of pulleys 38, are fixed, and each ring 40 has an air suction hole 40*a* having a diameter of approximately 6 mm. An arrow E indicates the direction toward the axis of a drum 101 (shown in FIG. 4). The metal hollow shaft 37 also has air suction holes 37*a* corresponding to the air holes 40*a*. Each pulley 38 has a frame 41. At one side periphery of the pulley 38 a plurality of holes 41*a* have a diameter of approximately 4 mm. An inner round surface of the frame 47, having an inner aperture of a hole 41*a*, is tightly slidably connected to the ring 40, and an outer round surface of the frame 41, having an outer aperture of the hole 41*a*, has a height approximately equal to a height adding the height and the thickness of the belt 32 measured from the center of the metal hollow shaft 37. Therefore, so the sheet 100 on the belts 32 is easily suctioned by the air sucked through the holes 41*a*, 40*a* and 37*a* when one of the holes 41*a* coincides with the hole 40*a*. The rings 40 are fixed to the metal hollow shaft 37 by screws 40*b* respectively. As explained above, since the air tightness of the mechanical connection in the sheet suction pulley mechanism 131 is excellent for sucking air, then the sheet 100, e.g., the sheet just ejected from the image transcription unit 105, can be easily separated from the drum surface 101' against the electrostatic force attracting the sheet 100 to the drum surface 101'.

Figure 6:
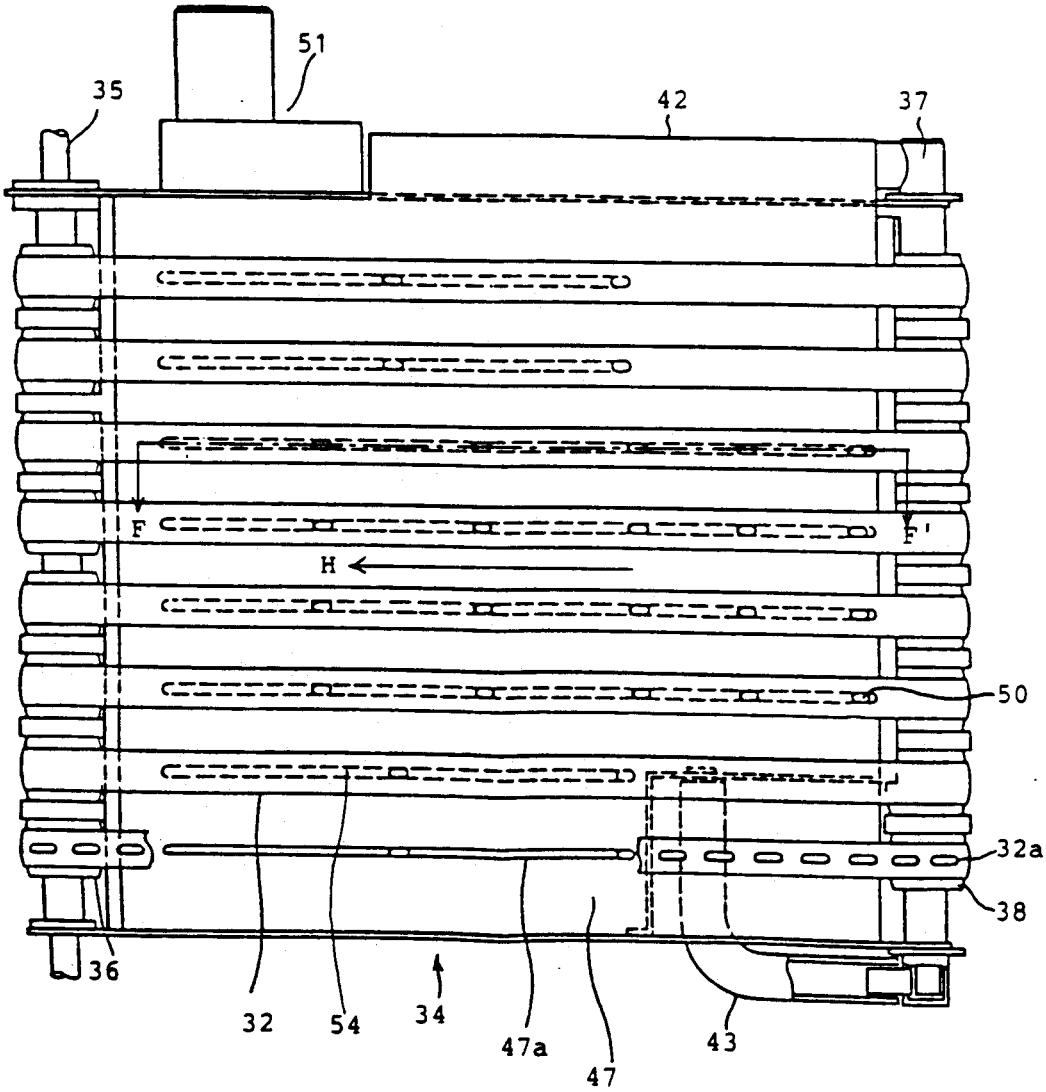
FIG. 6 is a plan view of a sheet suction belt mechanism.
Figure 7:
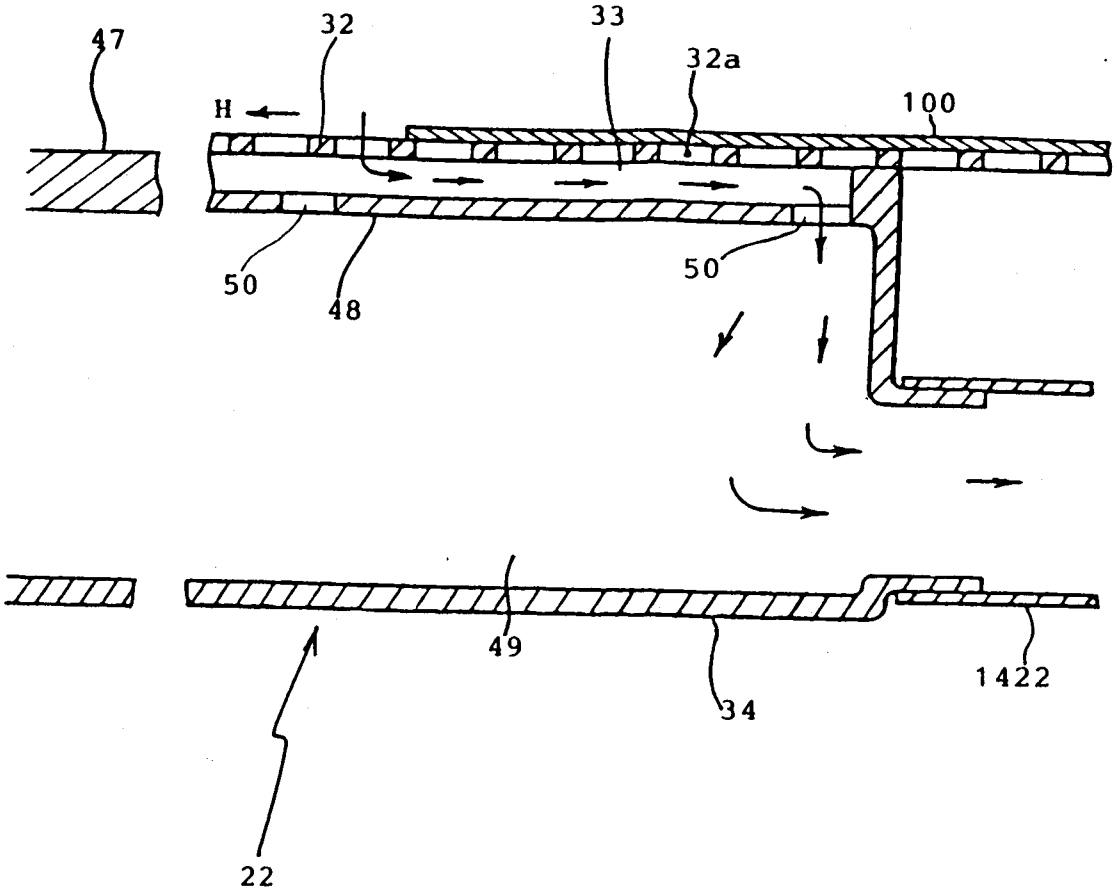
FIG. 7 is a partial cross-sectional view at a line F—F' in FIG. 6.

FIG. 6 is a plan view of the sheet suction belt mechanism 132 looking from above the belts 32. The sheet suction belt mechanism includes a plurality of belts 32 for carrying the sheet 100, made of dipped fluororubber each having a plurality of holes 32*a*, and a belt guide board 47 on which the belts 32 are slid in the direction H, as indicated by the arrow. The belt guide board 47 has long narrow air paths 47*a*, each formed like a ditch and provided along respective belts 32 so that the width of the air path 47*a* is narrower than the width of the belt 32. In this embodiment, the width, the depth, and the length of the air path 47*a* are approximately 6 mm, 2 mm and 200 mm, respectively. The width of the belt 32 is approximately 20 mm and the thickness is approximately 1 mm. Under the belt guide board 47 there is an air exhausting chamber 49 (FIG. 7). The air path 47*a* has a plurality air holes 50 at the bottom which vent to the air exhausting chamber 49 connected to the air exhausting blower 141 through the air exhausting room 143 as explained with reference to FIG. 3. Since the long path can not avoid an increase of flow resistance, extra air holes are added having a proper interval along the air path 47*a* in order to prevent a decrease in the attraction force exerted on the sheet. Usually, the interval between the air holes 50 is made small at the curved portion of the route 33 in FIG. 4 and gradually widens toward the flat portion. This leads to enhancement of the attraction force at the curved portion of the sheet carrying path. Furthermore, the air path 47*a* at both sides, in this case two air paths at each side, are shorter than the four air paths at the central zone. This is because useless suction is minimized when sheets of short size, for instance, half of the full size, are transferred. FIG. 7 is a partial cross-sectional view taken at a line F—F' in FIG. 6. In FIG. 7, the same reference numerals as in FIG. 6 designates the same part as in FIG. 6. As shown in FIG. 7, the air holes 50 are arranged, having an interval longer than the pitch of the holes 32*a* in the belt 32. Therefore, when there is no sheet 100 on the belts 32, the outside air of the sheet suction belt mechanism 132 is sucked to the air path 47*a* through the holes 32*a* and the air in the air path 47*a* is sucked to the air exhausting room 49 through the holes 50, whose area is approximately 80 $mm^2$. However when the sheet 100 is carried on the belts 32 in a direction shown by an arrow H and partially covers the holes 32*a* as shown in FIG. 7, the outside air is sucked to the air path 47*a* through uncovered holes 32*a* and flows in the air path 47*a* so as to be sucked to the air exhausting room 49 through the holes 50. In this case, since the air path 47*a* is narrow, the speed of the air flow in the air path 47*a* is increased. This high speed air flow in the air path 47*a* produces a stronger suction force at the holes 32*a*. In other words, due to Bernoilli's theorem, the high speed air flow increases the sucking force on the sheet 100 being carried on the belts 32.

Because of providing the air path 47*a*, the sheet 100 can be stably carried along the curved route 33 without increasing the air flow rate of the air exhausting blower 141.

The optimum width and the depth of the air path 47*a* and the interval between holes 50 are determined by considering the carrying speed of the sheet 100, the property of the sheet 100 and the size of the sheet 100.

Figure 8:
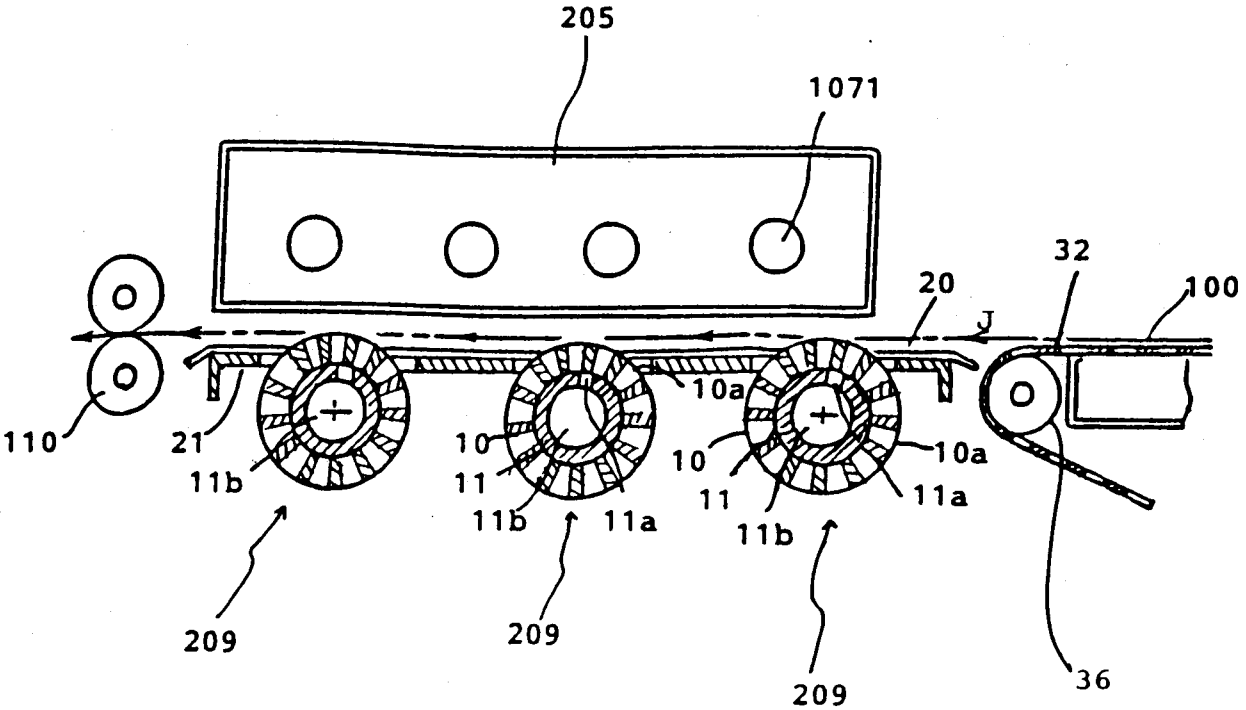
FIG. 8 is a cross-sectional side view of the sheet suction roller mechanism taken at the line R—R' in FIG. 10.
Figure 9:
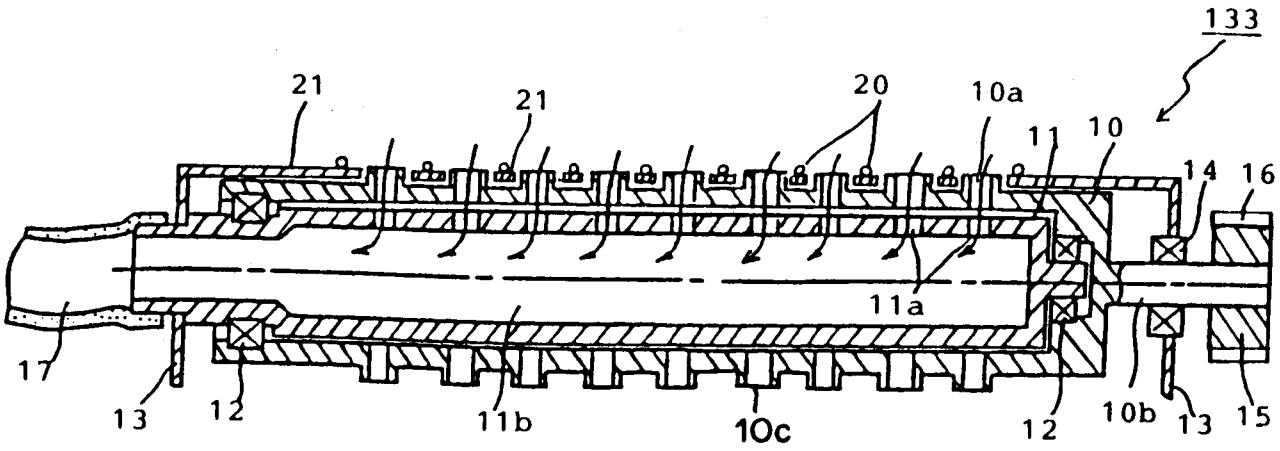
FIG. 9 is a cross-sectional side view of the suction roller.
Figure 10:
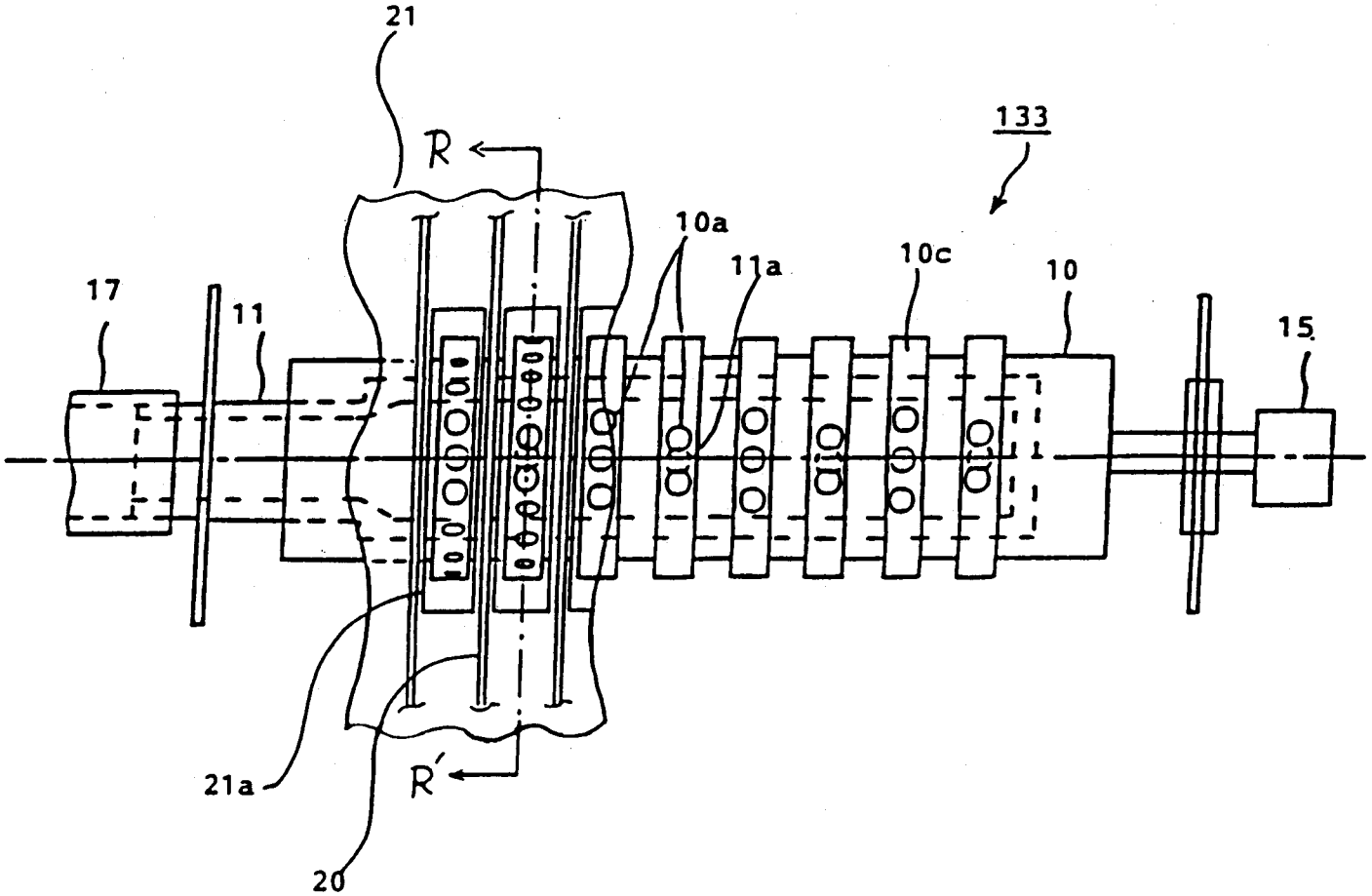
FIG. 10 is a cross-sectional plan view of the suction roller.

The sheet suction roller mechanism 133 will be disclosed with reference to FIGS. 8, 9 and 10. In FIGS. 8, 9 and 10, the same reference numerals designate the same units or parts. FIG. 8 illustrates the function of the sheet suction roller mechanism 133 by way of a cross-sectional side view taken along the line R—R' in FIG. 10. The sheet suction roller mechanism 133 comprises a plurality of suction rollers 209 arranged perpendicular to a sheet carrying direction J, having an interval less than half the sheet length between the suction rollers 209 adjacent to each other, and a sheet guide board 21 covering the suction rollers 209. Therefore, when the sheet 100 is fed to the fixing path of the fixing unit 107 from the sheet suction belt mechanism 132, the sheet 100 is carried only by suction rollers 209, and belts are not used any more.

FIG. 9 is a cross-sectional view of the sheet suction roller mechanism 133 on a vertical plane including a rotating axis of the suction roller 209. The suction roller 209 includes a fixed hollow shaft 11 having a hollow 11*b* connected to the air exhausting room 143 through the air exhausting duct 1423 (see FIG. 3) and a cylinder 10 rotating around the hollow shaft 11 through bearings 12 by a pulley 15 fixed to a shaft 10*b* connected to the cylinder 10. The fixed hollow shaft 11 has a plurality of air suction holes 11*a* arranged at predetermined intervals on a cylindrical wall of the hollow shaft 11 in a line parralel to the axis of the hollow shaft 11. The air suction holes 11*a* are directed upward. The cylinder 10 has a plurality of ring shaped ridges 10*c*, corresponding to the air suction holes 11*a*, extending outward so that the outer edges of the ridges 10*c* appear on the sheet guide board 21 through four-sided holes 21*a* provided in the guide board 21. At the ridges 10*c*, there are a plurality of air suction holes 10*a* approximately 8 mm in diameter so that each hole 10*a* can sequentially meet with the hole 11*a* of the hollow shaft 11 as the cylinder 10 is rotated around the hollow shaft 11. The air suction holes 10*a* are provided in the ridges 10*c* so that the holes 10*a* coincide with the holes 11*a* alternately as the cylinder 10 is rotated around the hollow shaft 11, as shown in FIG. 10. On the sheet guide board 21, a plurality of metal wires 20 are fixed between the ridges 10*c* and the outer sides of the ridges near both ends of each cylinder 10. These metal wires reduce the friction produced between the sheet 100 and the upper surface of the sheet guide board 21. The sheet 100 produces humidity under the fixing flush light, so that the upper surface of the sheet guide board 21 becomes wet after fixing many sheets 100. This results in increasing the friction between the sheet 100 and the upper surface of the sheet guide board 21. The metal wires 20 are for decreasing the friction. The aperture sizes of the holes 10*a* are made so that they are all equal. However, some of the holes 11*a* are made so that the inner holes are larger than the outer holes. This is for keeping high air suction efficiency when the size of the sheet 100 is small, otherwise a lot of non-effective suction air flows through the outer holes when the sheet size is small.

Since all the parts in the sheet suction roller mechanism 133 are made of metal, the mechanism 133 has no problem because of high temperature, which can rise to approximately 300° C. during 10 minutes of a fixing operation, under the strong irradiation of the flush light of the fixing unit 107. This results in allowing the fixing unit 107 to stably fix plenty of sheets 100 at high speed. Since air suction can be performed by the tight air connection between metal cylinder 10 and the metal hollow shaft 11, the air suction efficiency increases.

What is claimed is:

1. A sheet carrying mechanism for carrying a recording sheet having a specified size in an image forming apparatus, from image transcription means for transcribing toner images on an image bearing member onto the recording sheet to image fixing means for fixing the toner images onto the recording sheet, said sheet carrying mechanism comprising:

air exhausting means for suctioning the recording sheet in the sheet carrying mechanism;

a plurality of rotatable endless belts for carrying the recording sheet after the recording sheet is suctioned to said endless belts; and sheet suction belt means for carrying the recording sheet along a curved sheet carrying route from the image transcription unit to the image fixing means, said sheet suction belt means comprising:

a plurality of first air suction holes on each one of said endless belts, arranged in a line along a center line of each of said endless belts, and being spaced by a first interval;

a curved belt guide board corresponding to the curved sheet carrying route, for moving said endless belts attaching to an upper surface of said curved belt guide board, said curved belt guide board having a plurality of ditches in an upper surface along respective center lines of said endless belts, each ditch being narrower than said endless belts in width and having a plurality of second air suction holes spaced by a second interval which is less than the first interval; and an air exhausting chamber, located under said curved belt guide board and connected to said air exhausting means, said second air suction holes opening therein.

2. A sheet carrying mechanism according to claim 1, wherein said ditches have a pattern on said curved belt guide board such that the ditches at an outer side of said curved belt guide board are shorter in length than the ditches at an inner side, only the inner side ditches being located at a sheet entrance portion of said sheet suction belt means.

3. A sheet carrying mechanism according to claim 1, further comprising:

sheet suction roller means for carrying the recording sheet through the image fixing means and receiving irradiation of flush light from the image fixing means, said sheet suction roller means comprising:

a plurality of sheet suction rollers arranged perpendicular to a direction in which the recording sheets are carried, being spaced at an interval less than half the size of the recording sheet in the direction the sheet is carried, each of said sheet suction rollers comprising:

a metal hollow shaft having a hollow connected to said air exhausting means and having third air suction holes arranged in a line parallel to an axis of said hollow shaft and directed upward; and a metal hollow cylinder having a plurality of ring shaped ridges each having a plurality of fourth air suction holes extending in an outward direction, one of said fourth air suction holes coinciding with one of said third air suction holes as said metal hollow cylinder rotates around said metal hollow shaft, wherein inner apertures of said fourth air suction holes being mechanically slidingly connected to apertures of said third air suction holes, respectively, as said metal hollow cylinder rotates around said metal hollow shaft, and an outer aperture of said fourth air suction holes touching the recording sheet being carried; and a metal sheet guide board covering said sheet suction roller having a plurality of fifth air suction holes, upper peripheries of said ring shaped ridges extending through said fifth air suction holes exposing a few of said fourth air suction holes.

4. A sheet carrying mechanism according to claim 3, wherein said metal sheet guide board has a plurality of wires attached to the upper surface of said metal sheet guide board parallel to the carried direction of the recording sheet, at least one of said wires being attached between adjacent ones of said fifth air suction holes.

5. A sheet carrying mechanism according to claim 3, wherein said third air suction holes have aperture sizes such that the aperture sizes of said third air suction holes at an outer side of said metal hollow shaft in a direction perpendicular to the direction the sheet is carried are smaller than the aperture sizes of said third air suction holes at an inner side of said metal hollow shaft.

6. A sheet suction belt mechanism for carrying a sheet along a sheet carrying route by using an air suction force, said sheet suction belt mechanism comprising:

air exhausting means for suctioning the sheet in the sheet suction belt mechanism;

a plurality of endless belts rotated in parallel along the sheet carrying route, for carrying the sheet and suctioning the sheet onto said endless belts, each one of said endless belts having a plurality of first air suction holes arranged along a center line of said endless belts;

a belt guide board, placed along a direction of said endless belts for moving said endless belts attaching to an upper surface of said belt guide board, said belt guide board having a plurality of ditches along respective center lines of said endless belts, each ditch being narrower in width than said endless belts and having a plurality of second air suction holes spaced at an interval less than that of the first air suction holes; and an air exhausting chamber located under said belt guide board and connected to said air exhausting means, said second air suction holes opening therein.

7. A sheet suction belt mechanism according to claim 6, wherein said ditches form a pattern on said belt guide board such that said ditches located at an outer side of said belt guide board perpendicular to a direction in which the sheet is carried are shorter in length than said ditches at an inner side of said belt guide board, only said inner side ditches being located at a sheet entrance portion of said sheet suction belt mechanism.

8. A sheet suction roller mechanism for carrying a sheet, said sheet having a specified size suction roller mechanism comprising:

air exhausting means for suctioning the sheet to be carried;

a plurality of sheet suction rollers arranged perpendicular to a direction in which the sheet is carried, and spaced at intervals less than the size of half of the sheet in the direction the sheet is carried, each one of said sheet suction rollers comprising:

a metal hollow shaft having a hollow connected to said air exhausting means and having first air suction holes arranged in a line parallel to an axis of said hollow shaft and directed upward; and a metal hollow cylinder, enclosing said metal hollow shaft having a plurality of ring shaped ridges each having a plurality of second air suction holes directed outward, one of said second air suction holes coinciding with one of said first air suction holes as said metal hollow cylinder rotates around said hollow shaft, an aperture of said second air suction holes being mechanically slidingly connected to apertures of said first air suction holes as said hollow cylinder rotates around said hollow shaft and outer apertures of said second air suction holes touching the sheet being carried; and a metal sheet guide board covering said sheet suction roller having third air suction holes, upper peripheries of said ring shaped ridges extending through said third air suction holes provided in said sheet guide board, exposing certain ones of said second air suction holes.

9. A sheet suction roller mechanism according to claim 8, wherein said metal sheet guide board has a plurality of wires attached to an upper surface thereof and parallel to the direction the sheet is carried, at least one of said plurality of wires being attached between adjacent ones of said third air suction holes.

10. A sheet suction roller mechanism according to claim 8, wherein said first air suction holes have aperture sizes such that the aperture sizes of said first air suction holes at an outer side of said metal hollow shaft perpendicular to the direction the sheet is carried being smaller than the aperture sizes of said first air suction holes at an inner side of said metal hollow shaft.

* * * * *

UNITED STATES PATENT AND TRADEMARK OFFICE

CERTIFICATE OF CORRECTION

PATENT NO. : 5,031,002

DATED : JULY 9, 1991

INVENTOR(S) : MASANORI YAGUCHI

It is certified that error appears in the above-identified patent and that said Letters Patent is hereby corrected as shown below:

Col. 2, line 36, "short." should be --short life.--.

Col. 3, line 6, "can" should be --can be--;
line 41, "no" should be --a--.

Col. 4, line 53, "a curved" should be --a prior art curved--;
line 56, "a curved" should be --a prior art curved--.

Col. 6, line 67, "frame 47," should be --frame 41,--.

Col. 7, line 5, "so" should be deleted.

Col. 8, line 40, "parralel"should be --parallel--.

Signed and Sealed this

Sixth Day of April, 1993

*Attest:*

STEPHEN G. KUNIN

*Attesting Officer*

*Acting Commissioner of Patents and Trademarks*

UNITED STATES PATENT AND TRADEMARK OFFICE

CERTIFICATE OF CORRECTION

PATENT NO. : 5,031,002

DATED : July 9, 1991

INVENTOR(S) : Masanori Yaguchi

It is certified that error appears in the above-identified patent and that said Letters Patent is hereby corrected as shown below:

Title page, Col. 2, line 3, after "Japan", insert the following which were inadvertently omitted by the Patent Office:

--608,938 9/1948 Great Britain.
0225484 6/1987 Europe.

OTHER PUBLICATIONS

XEROX DISCLOSURE JOURNAL, Vol. 9, No. 2, March/April 1984, Stamford, Connecticut, U.S., "Flow Reduction on Gated Transports", by J.J. Burnard, pps. 119-120.--.

Col. 3, line 41, after "frame" change "a" to --on--.

Signed and Sealed this

Twenty-second Day of June, 1993

*Attest:*

Michael K. Kirk

MICHAEL K. KIRK

*Attesting Officer*

*Acting Commissioner of Patents and Trademarks*